United States Patent [19]

Brink

[11] Patent Number: 4,897,213

[45] Date of Patent: Jan. 30, 1990

[54] GRANITE CLEANING AGENT AND PREPARATION THEREOF

[76] Inventor: Douglas F. Brink, 130 Tremont St., Barre, Vt. 05641

[21] Appl. No.: 257,539

[22] Filed: Oct. 14, 1988

[51] Int. Cl.[4] ..... C11D 7/08; C11D 7/10; C11D 7/50

[52] U.S. Cl. ..... 252/143; 134/3; 252/79.3; 252/79.4; 252/142; 252/541

[58] Field of Search ..... 134/3; 252/79.3, 79.4, 252/136, 142, 143, 541

[56] References Cited

U.S. PATENT DOCUMENTS

| | | | |
|---|---|---|---|
| 1,574,406 | 2/1926 | Nelson | 252/142 |
| 1,574,407 | 2/1926 | Nelson | 252/541 |
| 2,278,257 | 3/1942 | Gallagher | 252/79.3 |
| 2,558,013 | 6/1951 | Staubly | 252/142 |
| 2,714,094 | 7/1955 | McNally | 252/142 |
| 3,150,007 | 9/1964 | Kovachy | 134/4 |
| 3,481,879 | 12/1969 | Salomone | 252/136 |

FOREIGN PATENT DOCUMENTS

| | | | |
|---|---|---|---|
| 291053 | 8/1965 | Australia | 252/142 |
| 3637711 | 5/1988 | Fed. Rep. of Germany | 252/142 |
| 52-74604 | 6/1977 | Japan | 252/143 |

*Primary Examiner*—Dennis Albrecht
*Attorney, Agent, or Firm*—Thomas N. Neiman

[57] ABSTRACT

It has long been the practice to clean monuments and memorials through the use of harsh chemicals or physical removal systems, such as sand blasting. A compound containing ammonium bifluoride ($NH_4F.HF$), denatured alcohol and water is mixed in an aqueous solution for use as a cleaning agent for all granite products and structures. A method of cleaning the granite items is also disclosed.

2 Claims, No Drawings

GRANITE CLEANING AGENT AND PREPARATION THEREOF

This invention pertains to cleaning agents, and in particular to such cleaning agents for use in removing weathering, micro-organisms and dirt from all granite structures and products.

The most common approaches that currently exist in the cleaning of granite monuments, memorials, buildings and other granite items are the use of physical cleaning devices, such as sandblasting units, and the use of strong acids, such as muriatic acid and high water pressure devices (minimum of 100 pounds per square inch required). All these approaches have problems associated with their use. Sandblasting equipment and high pressure devices are expensive and, therefor, not economical for small stone cleaning. Additionally, the use of this technique can harm nearby shrubs and grass and the user must exercise caution to avoid those difficulties. The use of straight acidic cleaners also creates problems. The acid can be harmful to the hands and face of the user and can kill nearby shrubbery and grasses and, at the same time, can discolor the stone being cleaned. What is needed is a cleaning agent that is economical to use. Additionally, what is needed is a cleaning agent that is effective and is not harmful to the user or to the environment when used as directed.

Clearly, it is desirable for a cleaning agent that does not contain the limitations described above and at the same time is simple and practical to operate. It is the object of this invention, then to set forth an improved cleaning agent device which avoids the disadvantages limitations, above-recited, which obtain in current cleaning agents. It is also the object of this invention to teach a cleaning agent which is simple to use. It is another object of this invention to teach a cleaning agent that is safe and effective for the user of the product and, at the same time, is safe for the environment when used as directed. Particularly, it is the object of this invention to set forth a cleaning agent, for use in removing weathering, micro-organisms and dirt from granite monuments, memorials, buildings and other granite products, comprising a mixture of ammonium bifluoride and denaturated alcohol; an approximate proportion of 11.2 percent ammonium bifluoride; an approximate proportion of 18.7 percent denatured alcohol or similar alcohol; and the balance an approximate proportion of 70.1 percent water to complete the solution.

It is another object of this invention to teach a method of cleaning granite monuments, memorials, buildings and other granite products, comprising the steps of placing one pound of granular ammonium bifluoride in a container; adding an amount of 1.67 pounds of denaturated alcohol or a similar ethyl alcohol to said granular ammonium bifluoride; mixing the above-identified mixture with sufficient water to form a total solution of one gallon; coating the article to be cleaned with said solution by means of a brush, sprayer or like means; allowing said mixture to be in contact with said article for a period of time; and rinsing said solution with plain water under a minimum amount of pressure.

Further objects and features of this invention will become more apparent by reference to the following description. The following example represents the preferred embodiment of the invention. The parts and percentage figures are expressed on a weight basis throughout the specification. The cleaning agent was prepared as follows:

Ammonium Bifluoride: 11.2
Denatured Alcohol: 18.7
Water: 70.1

Ammonium bifluoride is an orthorhombic crystal that is freely soluble in water and has a molecular weight of 57.05. It is acidic and has been used for cleaning and purifying purposes. The user would place one pound of the ammonium bifluoride in a pail or like vessel. One quart of denatured alcohol (weighting approximately 1.67 pounds) is added to the mixture. The user will then add sufficient water, approximately three quarts weighting 6.25 pounds, to complete the one gallon solution. The weight of the completed solution will be approximately 8.92 pounds per gallon of solution. The user mixes the solution and then coats the item being cleaned with the solution. This is usually done with a brush. The solution is left on the item to be cleaned for a period of time. It is not necessary to leave the solution on the item for a long period of time. The solution is then rinsed off the item. An ethyl alcohol may be substituted for the denatured alcohol in similar proportions. The purpose of the alcohol is to raise the ph of the solution and the buffering of the solution will result in making it environmentally safe for humans and vegetation and, at the same time, not inhibit the cleaning effectiveness of the ammonium bifluoride.

While I have described my invention in connection with specific embodiments thereof, it is clearly to be understood that this is done only by way of example and not as a limitation to the scope of my invention as set forth in the objects thereof and in the appended claims.

I claim:

1. A cleaning agent, for use in removing weathering, micro-organisms and dirt from granite monuments, memorials, buildings and other granite products, consisting of:

a mixture of ammonium bifluoride and denatured alcohol;

an approximate proportion of 11.2 percent ammonium bifluoride;

an approximate proportion of 18.7 percent denatured alcohol or similar ethyl alcohol; and the balance an approximate proportion of 70.1 percent water to complete the solution.

2. A method of cleaning granite monuments, memorials, buildings and other granite products, consisting of the steps of:

placing one pound of granular ammonium bifluoride in a container;

adding an amount of 1.67 pounds of denatured alcohol or a similar ethyl alcohol to said granular ammonium bifluoride;

mixing the above-identified mixture with sufficient water to form a total solution of one gallon;

coating the article to be cleaned with said solution by means of a brush or like means;

allowing said mixture to be in contact with said article for a period of time; and rinsing said solution with plain water under a minimum amount of pressure.

* * * * *